US005628866A

United States Patent [19]

Pool

[11] Patent Number: 5,628,866

[45] Date of Patent: May 13, 1997

[54] MASKING MACHINE

[75] Inventor: Daniel L. Pool, Phoenix, Ariz.

[73] Assignee: 3M, St. Paul, Minn.

[21] Appl. No.: 537,031

[22] Filed: Sep. 29, 1995

Related U.S. Application Data

[63] Continuation of Ser. No. 175,317, Dec. 29, 1993, abandoned.

[51] Int. Cl.[6] ..... B32B 31/08; B32B 31/18

[52] U.S. Cl. ..... 156/527; 156/554; 156/577; 156/579; 206/395; 206/494; 428/124; 428/130

[58] Field of Search ..... 156/527, 554, 156/574, 577, 579; 206/389, 390, 395, 494; 428/124, 130

[56] References Cited

U.S. PATENT DOCUMENTS

| | | | |
|---|---|---|---|
| 4,263,347 | 4/1981 | Banta | 156/577 X |
| 4,357,198 | 11/1982 | Ezquerro | 156/391 |
| 4,379,019 | 4/1983 | Pool | 156/527 |
| 4,667,891 | 5/1987 | Pool | 242/75.4 |
| 4,681,785 | 7/1987 | Horn | 428/130 X |
| 4,750,968 | 6/1988 | Sweeny | 156/523 |
| 4,906,322 | 3/1990 | Hollier | 156/527 |
| 4,913,767 | 4/1990 | Longworth | 156/527 |
| 4,989,769 | 2/1991 | Longworth et al. | 156/527 X |
| 4,990,214 | 2/1991 | Heil et al. | 156/527 |
| 5,037,501 | 8/1991 | Lawson | 156/527 |
| 5,113,921 | 5/1992 | Pool | 156/71 |

*Primary Examiner*—James Sells

*Attorney, Agent, or Firm*—Parsons & Goltry; Robert A. Parsons; Michael W. Goltry

[57] ABSTRACT

A hand held masking machine for applying tape along both edges of a sheet of masking material which has relatively movable frame portions that engage and journal opposite ends of a roll of masking material to accurately position tape being applied to its edges; frame portions adapted to have end portions of tape on the machine adhered thereto so that the masking machine can adhere tape along both or only a desired one of the masking material edges; an adjustable cutting blade assembly that accommodates applying tapes of different widths to the masking material, and specially longitudinally folded rolls of masking material so that the taped masking material may be wider that the roll from which the masking material is dispensed.

14 Claims, 4 Drawing Sheets

MASKING MACHINE

This application is a continuation of application Ser. No. 08/175,317 filed 29 Dec. 1993, now abandoned.

TECHNICAL FIELD

The present invention relates to hand held masking machines of the type adapted to apply strips of pressure sensitive adhesive coated tape from rolls of the tape carried on the masking machine along both edges of a sheet of masking material (e.g., paper or polymeric film) from a supply of masking material also carried on the masking machine.

BACKGROUND ART

U.S. Pat. Nos. 4,379,019 (Pool et al) and 5,037,501 (Lawson) describe hand held masking machines of the type adapted to apply strips of pressure sensitive adhesive coated masking tape from rolls of the tape carried on the masking machine along both edges of a sheet of masking material (e.g., paper or polymeric film) from a supply of masking material also carried on the masking machine. While these masking machines are usable for that purpose, they do not provide all of the flexibility that may be desired in the use of such a masking machine.

DISCLOSURE OF INVENTION

The present invention provides a hand held masking machine of the type adapted to apply strips of pressure sensitive adhesive coated masking tape from rolls of that tape carried on the masking machine along either edge or both edges of a sheet of masking material (e.g., paper or polymeric film) pulled from a supply of masking material also carried on the masking machine, which masking machine provides several advantages over the known machines in the prior art including (1) a handle positioned generally centrally near the balance point of the masking machine that facilitates use of the masking machine with either hand and movement of the machine in either of two directions along a surface to be masked, (2) more stable, backlash free and accurate journaling of rolls of masking material mounted one at a time on the masking machine with respect to the rolls of masking tape even if those rolls of masking material vary slightly in length from each other, (3) easier adaptation of the masking machine to apply masking tape along either edge or along both edges of the masking material as may be desired for a particular application, and (4) the ability to use masking tapes of different widths along the edges of the masking material to provide different amounts of the adhesive coated tape projecting therefrom while still conveniently cutting the adhered together masking material and tape.

According to the present invention there is provided a hand held masking machine of the known type comprising a handle attached to a frame for the machine that is adapted to be grasped by a person using the masking machine; masking material mounting means on the frame adapted for mounting a roll of masking material for rotation about a masking material axis so that masking material from the roll can be conducted past a front edge of the frame; means on the frame adapted for mounting first and second rolls of pressure sensitive adhesive coated tape for rotation about axes generally parallel to the masking material axis with each of the rolls of pressure sensitive adhesive coated tape adjacent a different lateral edge of the roll of masking material and positioned on the side of the masking material mounting means opposite the front edge of the frame, the tape roll mounting means being adapted to position the rolls of pressure sensitive adhesive coated tape along the tape roll axes with a portion of each roll of tape along the adjacent edges of the rolls of pressure sensitive adhesive coated tape aligned with portions of the roll of masking material along the adjacent edge of the roll of masking material, and with a portion of each roll of tape projecting past the adjacent edge of the roll of masking material, and so that tapes conducted from the rolls of tape past the front edge will contact and become adhered to masking material being conducted from the roll of masking material with portions of the tapes projecting past the opposite edges of the masking material; and cutting means along the front edge of the frame adapted for cutting the adhered together masking material and tape. Unlike prior art masking machines, the frame of the hand held masking machine according to the present invention comprises a two part frame that includes (1) a main frame portion including a transversely extending part having the front edge and a first flange part attached to and projecting generally normal to the transversely extending part adjacent a first end on which are mounted the first tape roll mounting means and a portion of the masking material mounting means adapted to be positioned in a central opening in the adjacent end of the roll of masking material; and (2) a moveable frame portion. The moveable frame portion is mounted on the main frame portion for movement in a direction parallel with the transversely extending part of the main frame portion; and the moveable frame portion includes a second flange part attached to and projecting generally normal to the transversely extending part adjacent its end opposite the first flange part. The second tape roll mounting means and a portion of the masking material mounting means adapted to be positioned in a central opening in the end of the roll of masking material opposite the first flange part are mounted on the second flange part; and biasing means are provided between the movable frame portion and the main frame portion for pressing the flange parts against the opposite end surfaces of a roll of masking material engaged by the masking material mounting means. Thus, the tape roll mounting means engage the roll of masking material from both ends which provides stable, backlash free and accurate journaling for its rotation.

Because the flange parts are biased against the end surfaces of the roll of masking material the rolls of masking tape being applied to the masking material are accurately positioned with respect to the edges of masking material along which the tape is applied, even if the masking machine is used to dispense rolls of masking material that vary somewhat in length.

Also, such biasing of the flange parts against the end surfaces of the roll of masking material provides a desirable drag force on the roll of masking material in the masking machine to retain the roll of masking material in a desired orientation after a length of taped masking material is cut off on the cutting means.

The frame of the hand held masking machine may include portions adjacent each of the first and second tape roll mounting means which are particularly adapted to have an end portion of the tape mounted on the adjacent tape roll mounting means releasably adhered thereto to space the tape from its predetermined tape path along which it is adhered to the masking material, thereby affording convenient use of the masking machine to adhere tape along only a desired one of the edges of the masking material. This feature facilitates either right or left handed use of the machine and/or movement of the machine in either of opposite directions when it is being used to apply tape along only one of the edges of the masking material. Also, lengths of tape needed for various uses can conveniently and easily be removed from the roll of tape not being applied to the edge of the masking material.

The hand held masking machine according to the present invention may be adapted to receive tapes of different widths on the first and second tape roll mounting means because the novel cutting means it includes. That cutting means comprises a cutting blade assembly that has an elongate central portion having a cutting edge fixed on the frame along and generally parallel to its front edge, and end portions having cutting edges and distal ends that are mounted at the opposite ends of the central portion of the blade for movement longitudinally of its central portion with their cutting edges aligned between retracted and extended positions. Such movement affords changing the length of the cutting blade assembly and alignment of the distal ends of the end portions with the outer edge of tapes of different widths on the tape roll mounting means to facilitate cutting off adhered together masking material and tapes of different widths.

Also, the hand held masking machine may be used to apply lengths of tape along either end or both ends of a novel roll of masking material that is longitudinally folded in a special pattern so that when the masking material is unfolded the adhered together lengths of masking material and tape will be substantially wider that the length of the roll from which the masking material is dispensed.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
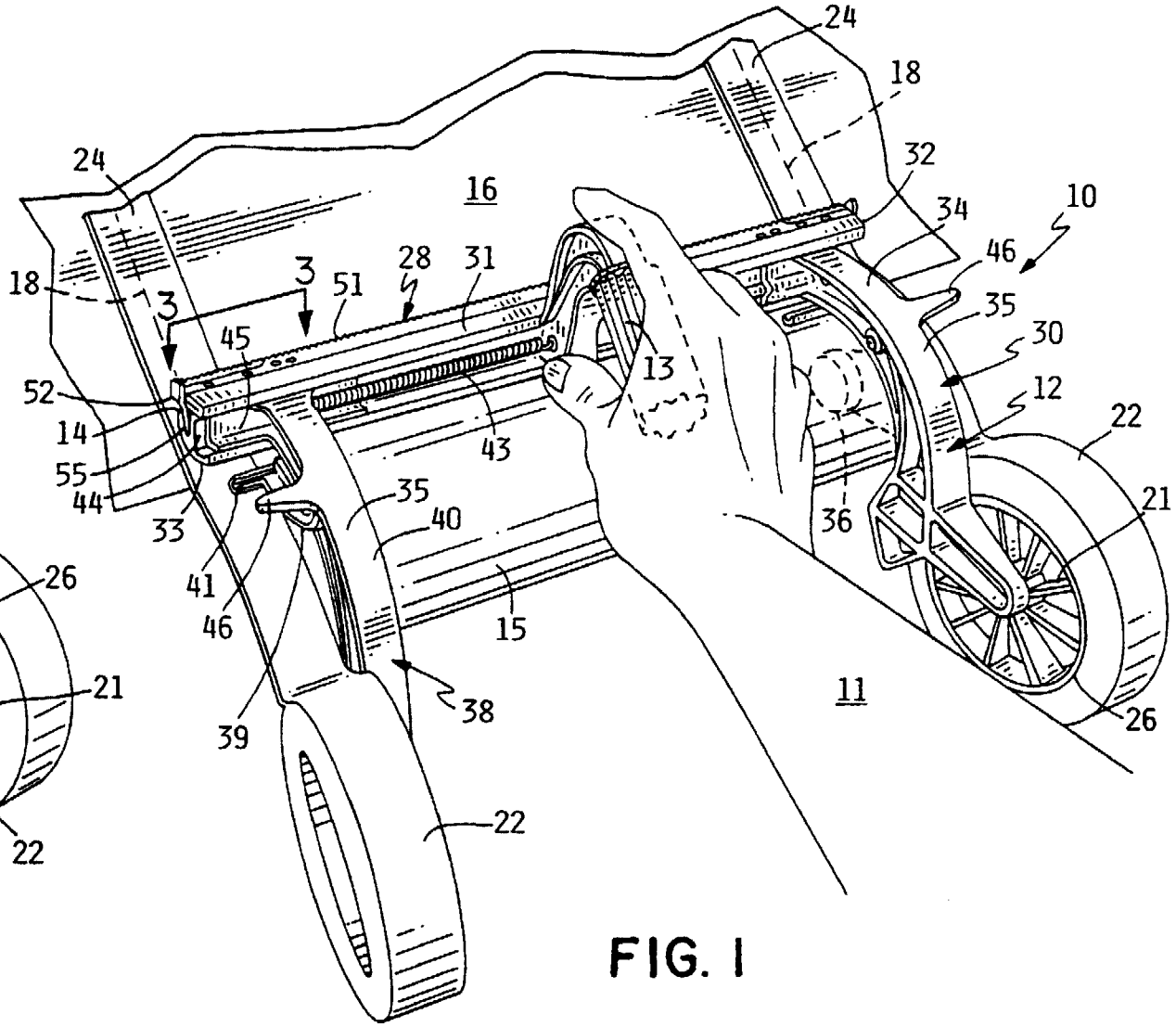
FIG. 1 is a perspective view of a hand held masking machine according to the present invention being used to apply two lengths of pressure sensitive adhesive coated masking tape from rolls of the tape on the machine along opposite edge portions of masking material being conducted from a roll of masking material on the machine with portions of the tapes projecting past the opposite edges of the masking material that are adhering the adhered together masking material and tape to a substrate.
Figure 2:
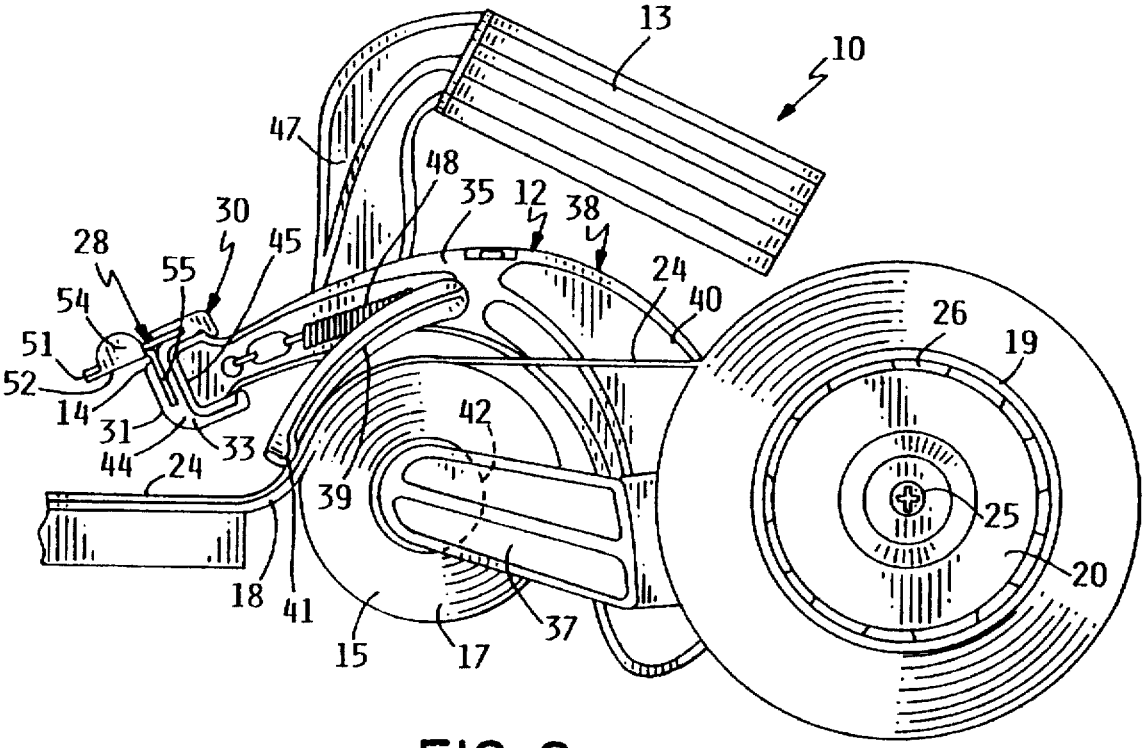
FIG. 2 is an end view of the hand held masking machine of FIG. 1.
Figure 3:
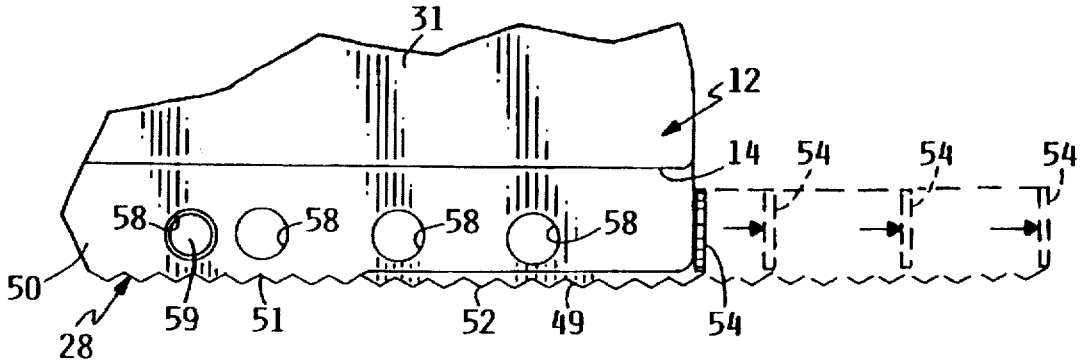
FIG. 3 is an enlarged fragmentary view taken approximately along line 3—3 of FIG. 1.
Figure 2A:
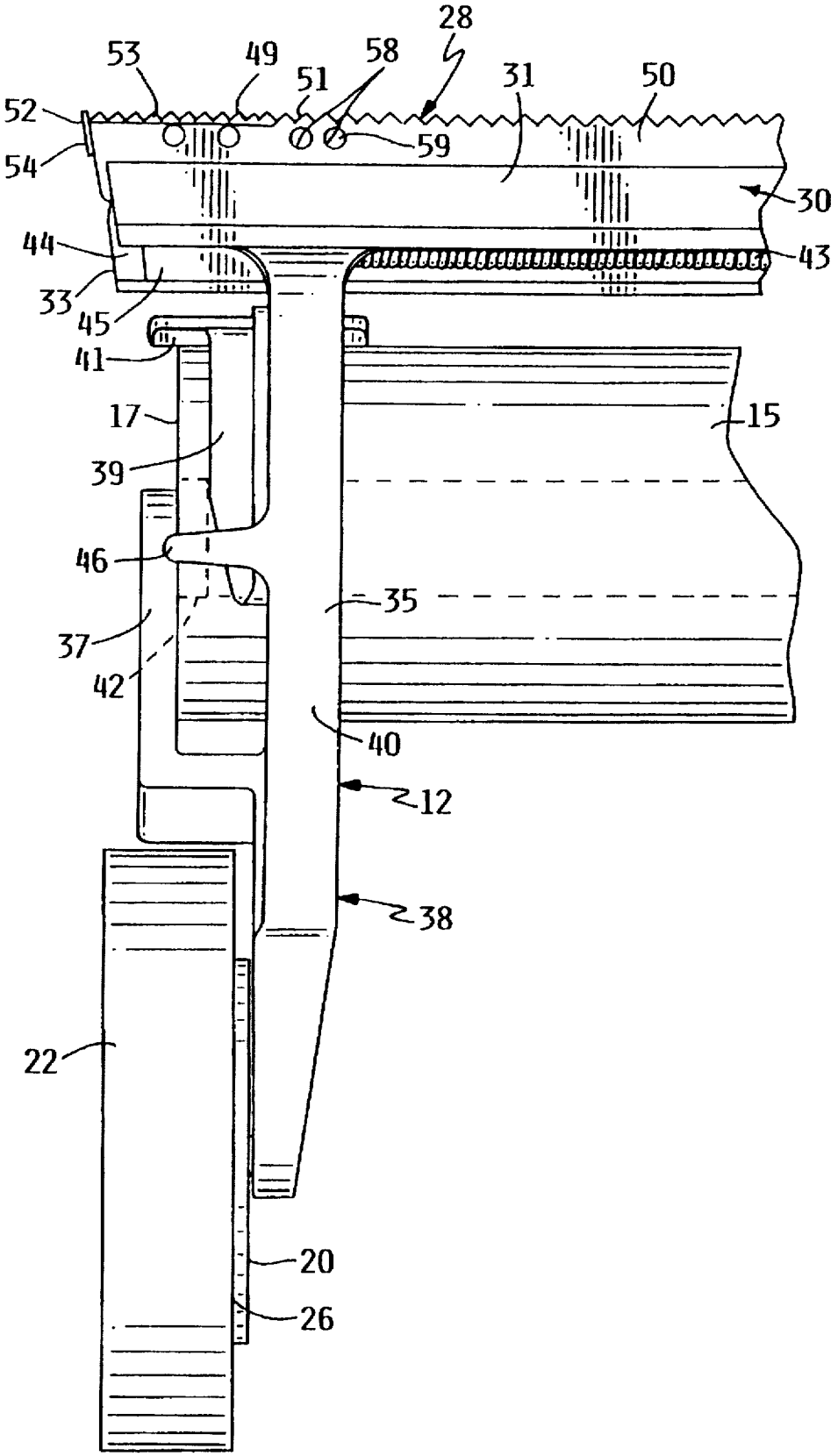
FIG. 2A is an enlarged fragmentary top view of one end of the hand held masking machine of FIG. 1.

Referring now to FIGS. 1 through 3 of the drawing, there is shown a hand held masking machine according to the present invention generally designated by the reference numeral 10.

Generally the hand held masking machine 10 comprises a frame 12 of a suitable metal or polymeric material having a front edge 14 and a handle 13 attached to the frame 12 and adapted to be grasped by a person 11 using the masking machine 10; masking material mounting means on the frame 12 adapted for mounting a roll 15 of masking material 16 (e.g., paper or polymeric material) having an axis, axially spaced end surfaces 17 defined by spaced lateral edges 18 of the masking material 16, and central openings through the end surfaces 17 that are ends of a cylindrical central opening through the roll 15. The masking material mounting means mounts the roll 15 of masking material 16 for generally coaxial rotation about a masking material axis that is parallel to the front edge 14 of the frame 12 so that masking material 16 from the roll 15 can be conducted past the front edge 14 of the frame 12; and first and second tape roll mounting means or hubs 20 and 21 rotatably mounted on the frame 12 by screws 25 and adapted respectively for receiving and frictionally engaging the inner surfaces on cores 19 of first and second rolls 22 of pressure sensitive adhesive coated tape 24 (e.g., conventional masking tape) positioned about the peripheries of the hubs 20 and 21 with adjacent edges of the cores 19 in the rolls 22 of tape 24 against flanges 26 along the adjacent edges of the hubs 20 and 21 so that the hubs 20 and 21 mount the rolls 22 of tape 24 for rotation about axes generally parallel to the masking material axis with each of the rolls 22 of tape 24 adjacent a different lateral edge 18 of the masking material 16 and positioned on the side of the masking material mounting means opposite the front edge 14 of the frame 12. The flanges 26 on the tape roll mounting means or hubs 20 and 21 are adapted to position the rolls 22 of tape 24 along the tape roll axes with a portion of each roll 22 of tape 24 along the adjacent edges of the rolls 22 of tape 24 aligned with portions of the roll 15 of masking material 16 along the adjacent edge 18 of the roll 15 of masking material 16, and with a portion of each roll 22 of tape 24 projecting past the adjacent edge 18 of the roll 15 of masking material 16, and so that tapes 24 conducted from the rolls 22 of tape 24 past the front edge 14 of the frame 12 will contact and become adhered to masking material 16 being conducted from the 15 roll of masking material 16 with portions of the tapes 24 projecting past the opposite edges 18 of the masking material 16. The masking machine 10 also includes cutting means provided by a cutting blade assembly 28 along the front edge 14 of the frame 12 having teeth adapted for cutting the adhered together masking material 16 and tapes 24.

The frame 12 includes a main frame portion 30 including an elongate transversely extending part 31 having the front edge 14 and first and second opposite ends 32 and 33, and a first flange part 34 fixedly attached to and projecting generally normal to the length of the transversely extending part 31 adjacent its first end 32. The second tape roll mounting means or hub 21 and a portion of the masking material 16 mounting means in the form of a cylindrical projection 36 adapted to be positioned in the central opening in the adjacent end surface 17 of the roll 15 of masking material 16 are mounted on the first flange part 34. The frame 12 also includes a moveable frame portion 38 mounted on the main frame portion 30 by means later to be explained for movement only in a direction parallel with the masking material axis and the elongate transversely extending part 31. The moveable frame portion 38 includes a second flange part 40 attached to and projecting generally normal with respect to the length of the elongate transversely extending part 31 of the main frame portion 30 and adjacent its second end 33. The first tape roll mounting means or hub 20 and a portion of the masking material mounting means in the form of a cylindrical projection 42 adapted to be positioned in a central opening in the adjacent end surface 16 of the roll 15 of masking material 16 are mounted on the second flange part 40 of the moveable frame portion 38 with the masking material axis, that is defined by the opposing Projections 36 and 42, extending generally parallel to the length of the transversely extending part 31 of the main frame portion 30. The moveable frame portion 38 is mounted on the main frame portion 30 for relative movement between (1) spaced positions at which end surfaces 17 of the roll 15 of masking material 16 can be moved between the opposing projections 36 and 42 on the flange parts 34 and 40 to load the roll 15 of masking material 16 onto the masking machine 10, and (2) closer positions at which the opposing projections 36 and 42 will engage in the central openings in the opposite end surfaces 17 of the roll 15 of masking material 16 to journal the roll 15 on those projections 36 and 42, and surfaces of the first and second flange parts 34 and 40 adjacent the projections 36 and 42 are along the opposite end surfaces 17 of the roll 15 of masking material 16. Biasing means in the form of a coil spring 43 are provided between the movable frame portion 38 and the main frame portion 30 for pressing those surfaces of the flange parts 34 and 40 adjacent the projections 36 and 42 against the opposite end surfaces 17 of the roll 15 of masking material 16 engaged by the projections 36 and 42 to both retain the projections 36 and 42 in the central openings in the opposite end surfaces 17 of the roll 15 of masking material 16, and to provide a frictional drag restricting rotation of the roll 15 of masking material 16 so that the roll 15 will not rotate on the projections 36 and 42 unless masking material 16 is being pulled from it. Because the flange parts 34 and 40 are biased against the opposite end surfaces 17 of the roll 15 of masking material 16, the rolls 22 of masking tape 24 being applied to the masking material 16 are accurately positioned with respect to the edges of masking material 16 along which the tape 24 is applied, even if the masking machine 10 is used to dispense rolls 15 of masking material 16 that vary somewhat in length (e.g., are over 0.5 inch longer or shorter than a nominal length for which the masking machine 10 is designed).

The means mounting the moveable frame portion 38 on the main frame portion 30 includes a portion of the transversely extending part 31 adjacent its second end 33 that defines a channel 44 extending longitudinally of the transversely extending part 31 and opening away from its front edge 14. The movable frame portion 38 includes a transverse shoe 45 fixed at an end of the second flange part 40 that projects through an open side of the channel 44, which shoe 45 is restrained for longitudinal sliding movement in the channel 44 and with the channel 44 provides the means mounting the moveable frame portion 38 on the main frame portion 30 for movement in a direction parallel with the masking material axis and transversely extending part 31. The coil spring 43 that provides the biasing means between the movable frame portion 38 and the main frame portion 30 is tensioned between the end of the second flange part 40 that projects through the open side of the channel 44 and a generally S-shaped part 47 of the main frame portion 30.

The generally S-shaped part 47 of the main frame portion 30 extends from the transversely extending part 31 and is attached to one end of the handle 13 to position the handle 13 generally centrally between the first and second ends 32 and 33 of the transversely extending part 31 with the center axis of the handle 13 oriented generally at a right angle with respect to the axis of the roll 15 of masking material 16 and with the handle spaced from the side of the roll 15 of masking material 16 at generally a central position near the balance point of the machine 10. With the handle 13 in this position, a person using the machine 10 can, with either hand, conveniently move the machine 10 in either of two directions (e.g., up or down or from right to left or from left to right) which greatly facilitates the masking of many surfaces.

The first and second flange parts 34 and 40 each include a generally C-shaped portion 35 that provides clearance for the roll 15 of masking material 16 along its inner surface, an extending portion from the end of that C-shaped portion 35 opposite the transverse part 31 on which the hub 20 or 21 is rotatably mounted, and a transversely extending L-shaped part 37 on which the cylindrical projection 36 or 42 that journals the roll 15 of masking material 16 is fixed. A drag member 39 is pivotably mounted at one end on each of the C-shaped portions 35, has a bar 41 at its opposite end adapted to ride along the surface of the tape 24 overlapping the masking material 16 adjacent the roll 15, and is biased by a coil spring 48 tensioned between the C-shaped portion 35 and the drag member 39 so that the bar 41 presses the tape 24 into engagement with the masking material 16 to adhere them together as the masking material 16 and tapes 24 are withdrawn from the machine 10.

Figure 1A:
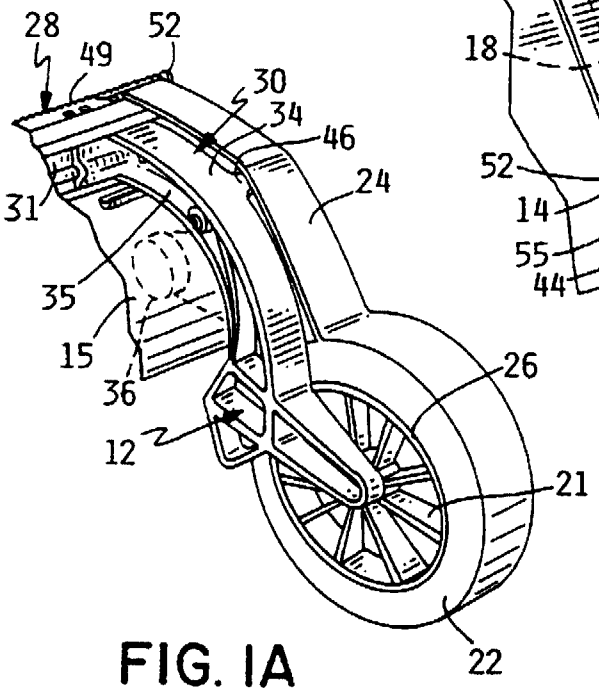
FIG. 1A is a fragmentary perspective view of a part of the hand held masking machine of FIG. 1 illustrating use of one of two portions of the frame for the masking machine adjacent its first and second tape roll mounting means to either of which an end portion of the tape mounted on the adjacent tape roll mounting means can be releasably adhered as illustrated to space the tape from its predetermined tape path along which it is adhered to the masking material.

The frame 12 also includes opposite projecting portions 46 projecting in opposite directions from the C-shaped portions 35 of the flange parts 34 and 40 adjacent each of the first and second tape roll hubs 20 and 21. The projecting portions 46 are each adapted to have an end portion of the tape 24 from the roll 22 mounted on the adjacent hub 20 or 21 releasably adhered across its surface opposite the roll 15 of masking material 16 and with the end of that end portion of the tape 24 adhered on the surface of the transversely extending part 31 adjacent the cutting blade assembly 28 as is illustrated in FIG. 1A. Such adhesion the end portion of the tape 24 across the surface of the projecting portion 46 and on the surface of the transversely extending part 31 spaces the tape 24 from the predetermined tape path along which it extends when it is being applied along the edge 18 of the masking material 16 as is illustrated in FIG. 1 so that it will not be adhered to the masking material 16 as the masking material 16 is withdrawn from the masking machine 10. The ability to adhere end portions of either of the tapes 24 across the projecting portions 46 and to the transversely extending part 31 or position the tape to adhere to the masking material 16 as it is withdrawn from the machine 10 affords convenient use of the masking machine 10 to adhere tape 24 along only one of the edges 18 of the masking material 16 and to easily change the edge 18 to which tape is being applied. Also, lengths of the tape 24 extending across one of the projecting portions 46 that are needed for various uses can easily be removed by pulling them from the roll and cutting them off across the cutting blade assembly 28, after which the newly formed end portion of the tape 24 can again be adhered across the projecting portion 46 and to the transversely extending part 31 of the frame 12.

The blade assembly 28 on the masking machine 10 is adapted to cut tape from different width rolls of tape 22 placed on the first and second tape roll mounting hubs 20 and 21. The blade assembly 2B includes an elongate flat central blade portion 50 that has projecting triangular teeth along one edge that define a cutting edge 51, and has a portion along its edge opposite the teeth that is fixed in a slot in the transverse part 31 of the frame 12 that opens along its front edge 14 with the portion of the central portion having the teeth defining the cutting edge 51 projecting from that front edge 14 and extending generally parallel with the transverse part 31 of the frame 12. The blade assembly 28 also includes end portions 52 that each include a blade part 53 having teeth defining a cutting edge 49 and each have a distal ends at which a tab part 54 projects at a right angle to the major surfaces of the blade part 53. The end portions 52 also each include a mounting part 55 extending along the side of the blade part 53 opposite the teeth, which mounting part 55 is disposed at about a right angle to the blade part 53. The mounting part 55 is slidably received in a slot 56 in the frame 12 disposed at a right angle to the slot in which part of the central blade portion 50 is fixed and disposed so that the surface of the blade part 53 opposite the slot 56 is against an adjacent surface of the central blade portion 50 which retains the mounting part 55 of the end portion 52 in the slot 56 while allowing it to slide in the slot 56 longitudinally of the central blade portion 50. The central blade portion 50 has a plurality of spaced through openings 58 (illustrated as four, see FIG. 3) adjacent each end, and each of the blade parts 53 has a dimple or detent 59 projecting along its surface that is adapted to be received in any one of the openings 58 to releasably retain the distal end of that end portion 52 in a position defined by that engagement that is designed to align the distal end of the end portion 52 with the outer edge of a roll 22 of tape 24 of a predetermined width and thereby facilitate cutting that tape 24 after it is adhered to the masking material 16. As an example, the openings 58 can be positioned to facilitate three quarter, one, one and one half, and two inch wide tape 24. The teeth on the central blade portion 50 are removed adjacent its ends to insure that even when the end portions 52 are in their most retracted positions with their tab parts 54 against the ends of the central blade portion 50, tape 24 being cut by the blade assembly 28 will initially only be engaged by one layer of teeth (i.e., the teeth on one of the end portions 52), and thus will be more easily initially cut than if it were engaged by two overlying layers of teeth.

Thus, the end portions 52 are mounted at the opposite ends of the central blade portion 50 for movement longitudinally of the central blade portion 50 with their cutting edges 51 and 49 aligned between retracted and extended positions; and such movement of the end portions 52, which is done manually, affords changing the length of the cutting blade assembly 28 and alignment of the distal ends 54 of the end portions 52 with the outer edges of rolls of tape 22 of different widths on the hubs 20 and 21 to facilitate cutting off the adhered together masking material 16 and tapes 24 of different widths formed by the machine 10.

Figure 4:
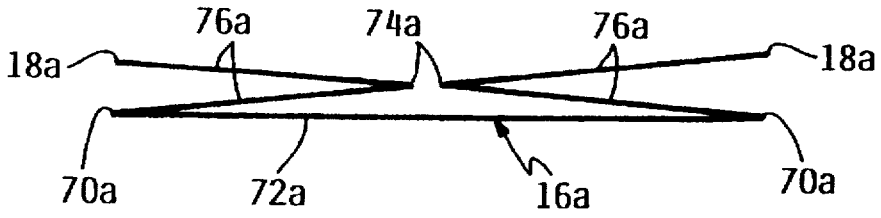
FIGS. 4, 5 and 6 are cross sectional views illustrating different ways elongate sheets of masking material used in the hand held masking machine may be longitudinally folded before it is helically wound into a roll.
Figure 5:
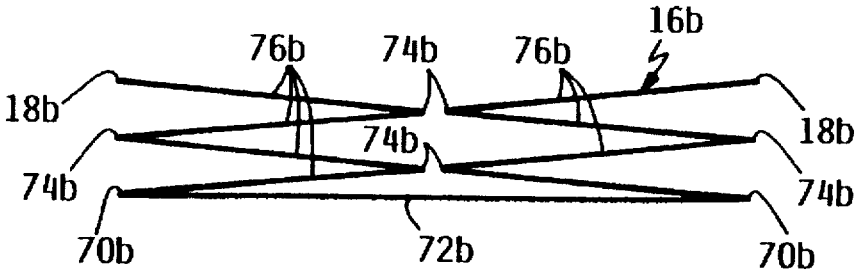
Figure 6:
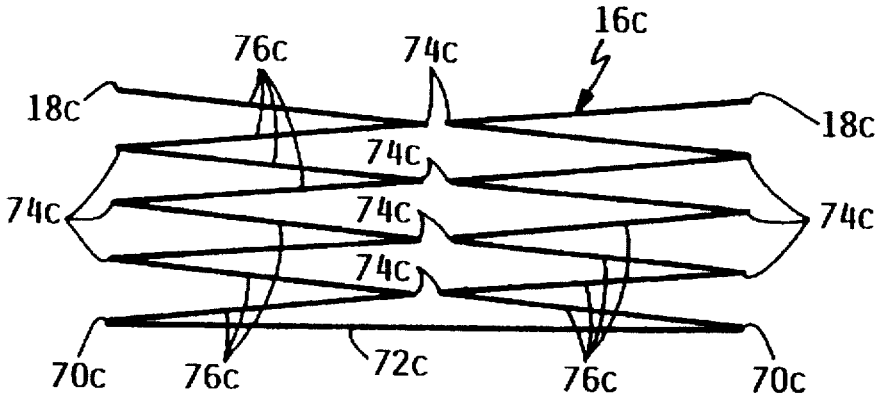

The masking material 16 in the roll 15 can comprise a helically wound flat elongate sheet of the masking material 16 which has a width between its edges 18 that is about the same as the axial length of the roll 15 between its end surfaces 17. Alternatively, the masking material may be helically wound elongate sheets of longitudinally folded masking material **16*a*, 16*b*, or 16*c* folded to have cross sections such as those illustrated in FIGS. 4, 5 and 6, respectively, which folded sheets have width dimensions between their opposite edges 18*a*, 18*b* or 18*c* that are substantially greater than the axial lengths of rolls into which the sheets are wound. Such elongate sheets of masking material in the rolls 16*a*, 16*b* or 16*c* are longitudinally folded along a plurality of parallel fold lines including a pair of spaced innermost fold lines 70*a*, 70*b*, or 70*c* each equally spaced from the adjacent edge 18*a*, 18*b* or 18*c* of the sheet. The innermost fold lines 70*a*, 70*b* or 70*c* are spaced from each other a distance about equal to the axial length of the roll into which the elongate sheet is wound to position the innermost pair of spaced fold lines 70*a*, 70*b* or 70*c* adjacent the end surfaces of the roll with a planar central pleat-like portion 72*a*, 72*b*, or 72*c* of the sheet extending between the innermost fold lines 70*a*, 70*b* or 70*c*. The parallel fold lines also include an odd number of outer fold lines 74*a*, 74*b* or 74*c* between each edge 18*a*, 18*b* or 18*c* of the sheet and the adjacent innermost fold line 70*a*, 70*b* or 70*c*. The outer fold lines 74*a*, 74*b* or 74*c* form an even number of outer pleat-like portions 76*a*, 76*b* or 76*c* of the sheet each less than half the width of the central pleat-like portion 72*a*, 72*b*, or 72*c* of the sheet and position the edges 18*a*, 18*b* or 18*c* of the sheet at the end surfaces of the roll into which the elongate sheet is wound. FIG. 4 illustrates such a longitudinally folded sheet of masking material 16*a* with two outer fold lines 74*a* and four outer pleat-like portions 76*a*; whereas FIG. 5 illustrates such a sheet of masking material 16*b* with six outer fold lines 74*b* and eight outer pleat like portions 76*b*; and FIG. 6 illustrates such a longitudinally folded sheet of masking material 16*b* with fourteen outer fold lines 74*c* and sixteen outer pleat-like portions 76*c***.

When the masking material **16*a*, 16*b* or 16*c* is of thin flexible material (e.g., polymeric film) it is preferable (as is taught in U.S. Pat. No. 5,113,921) to have the longitudinally extending edges of the central pleat-like portions 72*a*, 72*b*, or 72*c* and any longitudinally extending edges of the outer pleat-like portions 76*b* or 76*c* that are adjacent and help define the end surfaces of the roll into which the elongate sheet is wound spaced inwardly of the roll from the adjacent edge 18*a*, 18*b* or 18*c* of the sheet by a distance of at least about 0.003 inch to restrict contact of the pressure sensitive adhesive on the tape 24 with those edges of the pleat-like portions 72*a*, 72*b*, 72*c*, 76*b* or 76*c* when the tape 24 is adhered to the outer surface of the outermost pleat-like portion 76*a*, 76*b*, or 76*c* of the sheet forming the roll of masking material 16*a*, 16*b* or 16*c*. Also, as is taught in U.S. Pat. No. 5,113,921, it is preferable to have the longitudinally extending edges of the central pleat-like portions 72*a*, 72*b*, or 72*c* and any longitudinally extending edges of the outer pleat-like portions 76*b* or 76*c* that are adjacent and help define the end surfaces of the roll into which the elongate sheet is wound spaced inwardly of the roll from the adjacent edge 18*a*, 18*b* or 18*c* of the sheet by a distance of no greater than about 0.312 inch so that those underlying central and outer pleat-like portions 72*a*, 76*a*; 72*b*, 76*b*; or 72*c*, 76*c* will help to provide support radially of the roll of masking material for the radially outermost outer pleat-like portion 76*a*, 76*b* or 76*c* to assure firm engagement of the pressure sensitive adhesive on the tape 24 with the sheet adjacent either or both of its first edges 18*a*, 18*b* or 18*c* as the tape 24 and sheet are pulled from the masking machine 10 to form the adhered together masking material and tape. Any of the sheets of masking material 16*a*, 16*b*, and 16*c* can have tape 24 applied along either both of its edges 18*a*, 18*b* or 18*c* by the masking machine 10, and can subsequently be unfolded to its full width between its edges 18*a*, 18*b* or 18*c*** for use to mask a surface.

The present invention has now been described with reference to one embodiments thereof. It will be apparent to those skilled in the art that many changes can be made in the embodiment described without departing from the scope of the present invention. For example, when the masking machine 10 is used with polymeric masking material it may be useful to use a cut off blade assembly having teeth of the type described in U.S. Pat. No. 4,913,767 with a blade guard of the type described in U.S. Pat. No. 4,989,769. Also, it may be desirable to use tape tracking members of the type described in U.S. Pat. No. 4,990,214 to help guide both lengths of tape 24 from the rolls of tape 22 to the roll of masking material. Thus the scope of the present invention should not be limited to the structure described in this application, but only by structures described by the language of the claims and the equivalents of those structures.

I claim:

1. A hand held masking machine comprising:

a frame having a front edge;

a handle attached to said frame and adapted to be grasped by a person using the masking machine;

masking material mounting means on said frame adapted for mounting a roll of masking material having an axis, axially spaced end surfaces defined by spaced lateral edges of the masking material, and central openings through said end surfaces, said mounting means mounting the roll of masking material for generally coaxial rotation about a masking material axis defined by the mounting means so that masking material from the roll can be conducted past the front edge of the frame;

first and second tape roll mounting means on said frame adapted for mounting first and second rolls of pressure sensitive adhesive coated tape having axes and axially spaced opposite edges for coaxial rotation about tape roll axes generally parallel to said masking material axis with each of said rolls of tape adjacent a different lateral edge of the masking material and positioned on the side of said masking material mounting means opposite the front edge of said frame, said tape roll mounting means being adapted to position the rolls of tape along said tape roll axes with a portion of each roll of tape along the adjacent edges of the rolls of tape aligned with portions of the roll of masking material along the adjacent edge of the roll of masking material, and with a portion of each roll of tape projecting past the adjacent edge of the roll of masking material, and so that tapes conducted from the rolls of tape past said front edge will contact and become adhered to masking material being conducted from said roll of masking material with portions of the tapes projecting past the opposite lateral edges of the masking material; and cutting means along the front edge of said frame adapted for cutting the adhered together masking material and tapes, wherein said frame includes:

a main frame portion including a longitudinal transversely extending part having said front edge and first and second opposite ends, and a first flange part attached to and projecting generally normal to said transversely extending part adjacent said first end, said first tape roll mounting means and a portion of said masking material mounting means adapted to be positioned in the central opening through one end surface of the roll of masking material being mounted on said first flange part;

a moveable frame portion;

means mounting said moveable frame portion on said main frame portion for movement in a direction parallel with said transversely extending part of said main frame portion;

said moveable frame portion including a second flange part projecting generally normal to said transversely extending part adjacent the end of said transversely extending part opposite said first flange part, said second tape roll mounting means and a portion of said masking material mounting means adapted to be positioned in the central opening through the end surface of the roll of masking material opposite the central opening engaged by the portion of said masking material mounting means on said first flange part being mounted on said second flange part; and biasing means between said movable frame portion and said main frame portion for pressing said flange pads against the opposite end surfaces of a roll of masking material engaged by the masking material mounting means.

2. A hand held masking machine according to claim 1 wherein said handle has opposite ends and a longitudinal center axis between said ends, and said frame includes a part attaching one end of said handle to said main frame portion generally centrally between said first and second ends with said center axis oriented generally at a right angle with respect to the axis of the roll of masking material.

3. A hand held masking machine according to claim 1 wherein:

a portion of said transversely extending part adjacent said second end defines a channel extending longitudinally of said transversely extending part;

said movable frame portion includes a shoe slidably mounted in said channel to provide said means mounting said moveable frame portion on said main frame portion for movement in a direction parallel with said transversely extending part of said main frame portion; and said biasing means between said movable frame portion and said main frame portion comprises a coil spring tensioned between said movable frame portion and said main frame portion.

4. A hand held masking machine according to claim 1 wherein:

said frame includes two portions each adjacent one of said first and second tape roll mounting means and adapted to have an end portion of the tape mounted on the adjacent tape roll mounting means releasably adhered thereto to space the tape from the predetermined tape path, thereby affording convenient use of the masking machine to adhere tape along only one of the edges of the masking material.

5. A hand held masking machine according to claim 1 wherein:

said masking machine is adapted to receive tapes of different widths on said first and second tape roll mounting means, and said cutting means includes a cutting blade assembly including an elongate central portion having a cutting edge and being fixed on said frame along and generally parallel to said front edge, end portions having cutting edges and distal ends, and means mounting said end portions at the opposite ends of said central portion for movement longitudinally of said central portion with said cutting edges aligned between retracted and extended positions to afford changing the length of said cutting blade assembly and alignment of the distal ends of said end portions with the outer edges of tapes of different widths on said tape roll mounting means to facilitate cutting off the adhered together masking material and tapes of different widths.

6. A hand held masking machine according to claim 4 wherein:

said masking machine is adapted to receive tapes of different widths on said first and second tape roll mounting means, and said cutting means includes a cutting blade assembly including an elongate central portion having a cutting edge and being fixed on said frame along and generally parallel to said front edge, end portions having cutting edges and distal ends, and means mounting said end portions at the opposite ends of said central portion for movement longitudinally of said central portion with said cutting edges aligned between retracted and extended positions to afford changing the length of said cutting blade assembly and alignment of the distal ends of said end portions with the outer edges of tapes of different widths on said tape roll mounting means to facilitate cutting off the adhered together masking material and tapes of different widths.

7. A hand held masking machine comprising:

a frame having a front edge;

a handle attached to said frame and adapted to be grasped by a person using the masking machine;

masking material mounting means on said frame adapted for mounting a roll of masking material having an axis and axially spaced end surfaces defined by spaced lateral edges of the masking material, said mounting means mounting the roll of masking material for generally coaxial rotation about a masking material axis defined by the mounting means so that masking material from the roll can be conducted past the front edge of the frame;

first and second tape roll mounting means on said frame adapted for mounting first and second rolls of pressure sensitive adhesive coated tape having axes and axially spaced opposite edges for coaxial rotation about tape roll axes generally parallel to said masking material axis with each of said rolls of tape adjacent a different lateral edge of the masking material and positioned on the side of said masking material mounting means opposite the front edge of said frame, said tape roll mounting means being adapted to position the rolls of tape along said tape roll axes with a portion of each roll of tape along the adjacent edges of the rolls of tape aligned with portions of the roll of masking material along the adjacent edge of the roll of masking material, and with a portion of each roll of tape projecting past the adjacent edge of the roll of masking material, and so that tapes conducted from the rolls of tape past said front edge will contact and become adhered to masking material being conducted from said roll of masking material with portions of the tapes projecting past the opposite lateral edges of the masking material; and cutting means along the front edge of said frame adapted for cutting the adhered together masking material and tapes, wherein:

said frame includes two portions each adjacent one of said first and second tape roll mounting means and adapted to have an end portion of the tape mounted on the adjacent tape roll mounting means releasably adhered thereto to space the tape from the predetermined tape path, thereby affording convenient use of the masking machine to adhere tape along only one of the edges of the masking material.

8. A hand held masking machine according to claim 7 wherein:

said masking machine is adapted to receive tapes of different widths on said first and second tape roll mounting means, and said cutting means includes a cutting blade assembly including an elongate central portion having a cutting edge and being fixed on said frame along and generally parallel to said front edge, end portions having cutting edges and distal ends, and means mounting said end portions at the opposite ends of said central portion for movement longitudinally of said central portion with said cutting edges aligned between retracted and extended positions to afford changing the length of said cutting blade assembly and alignment of the distal ends of said end portions with the outer edges of tapes of different widths on said tape roll mounting means to facilitate cutting off the adhered together masking material and tapes of different widths.

9. A hand held masking machine comprising:

a frame having a front edge;

a handle attached to said frame and adapted to be grasped by a person using the masking machine;

masking material mounting means on said frame adapted for mounting a roll of masking material having an axis and axially spaced end surfaces defined by spaced lateral edges of the masking material, said mounting means mounting the roll of masking material for generally coaxial rotation about a masking material axis defined by the mounting means so that masking material from the roll can be conducted past the front edge of the frame;

first and second tape roll mounting means on said frame adapted for mounting first and second rolls of pressure sensitive adhesive coated tape having axes and axially spaced opposite edges for coaxial rotation about tape roll axes generally parallel to said masking material axis with each of said rolls of tape adjacent a different lateral edge of the masking material and positioned on the side of said masking material mounting means opposite the front edge of said frame, said tape roll mounting means being adapted to position the rolls of tape along said tape roll axes with a portion of each roll of tape along the adjacent edges of the rolls of tape aligned with portions of the roll of masking material along the adjacent edge of the roll of masking material, and with a portion of each roll of tape projecting past the adjacent edge of the roll of masking material, and so that tapes conducted from the rolls of tape past said front edge will contact and become adhered to masking material being conducted from said roll of masking material with portions of the tapes projecting past the opposite lateral edges of the masking material; and cutting means along the front edge of said frame adapted for cutting the adhered together masking material and tapes, wherein:

said masking machine is adapted to receive tapes of different widths on said first and second tape roll mounting means, and said cutting means includes a cutting blade assembly including an elongate central portion having a cutting edge and being fixed on said frame along and generally parallel to said front edge, end portions having cutting edges and distal ends, and means mounting said end portions at the opposite ends of said central portion for movement longitudinally of said central portion with said cutting edges aligned between retracted and extended positions to afford changing the length of said cutting blade assembly and alignment of the distal ends of said end portions with the outer edges of tapes of different widths on said tape roll mounting means to facilitate cutting off the adhered together masking material and tapes of different widths.

10. In combination:

a roll comprising a helically wound elongate sheet of masking material, said roll of masking material having an axis, axially spaced end surfaces defined by spaced lateral edges of the masking material, and a generally predetermined axial length between said end surfaces, said elongate sheet of masking material in said roll being longitudinally folded along a plurality of parallel fold lines, said fold lines including a pair of spaced innermost fold lines each about equally spaced from the adjacent edge of the sheet, the innermost fold lines being spaced from each other a distance about equal to the axial length of the roll to position the innermost pair of spaced fold lines adjacent the end surfaces of the roll with a planar central portion of the sheet extending between said innermost fold lines, and said fold lines also including an odd number of outer fold lines between each edge of the sheet and the adjacent innermost fold line, said outer fold lines forming an even number of portions of the sheet each less than half width of the central portion of the sheet on the same side of the central portion of the sheet, and positioning each of the edges of the sheet at a different one of the ends of the roll on the side of the folded sheet opposite the central portion of the sheet; and a hand held masking machine comprising:

a frame having a front edge;

a handle attached to said frame and adapted to be grasped by a person using the masking machine;

masking material mounting means on said frame, said mounting means mounting the roll of masking material for generally coaxial rotation about a masking material axis defined by the mounting means so that masking material from the roll can be conducted past the front edge of the frame;

first and second tape roll mounting means on said frame adapted for mounting first and second rolls of pressure sensitive adhesive coated tape having axes and axially spaced opposite edges for coaxial rotation about tape roll axes generally parallel to said masking material axis with each of said rolls of tape adjacent a different lateral edge of the masking material and positioned on the side of said masking material mounting means opposite the front edge of said frame, said tape roll mounting means being adapted to position the rolls of tape along said tape roll axes with a portion of each roll of tape along the adjacent edges of the rolls of tape aligned with portions of the roll of masking material along the adjacent edge of the roll of masking material, and with a portion of each roll of tape projecting past the adjacent edge of the roll of masking material, and so that tapes conducted from the rolls of tape past said front edge will contact and become adhered to masking material being conducted from said roll of masking material with portions of the tapes projecting past the opposite lateral edges of the masking material; and cutting means along the front edge of said frame adapted for cutting the adhered together masking material and tapes.

11. An untaped roll of masking material adapted for use on a hand held masking machine, said roll of masking material comprising a helically wound elongate sheet of masking material, having an axis, axially spaced end surfaces defined by spaced lateral edges of the masking material, and a generally predetermined axial length between said end surfaces and being adapted for use on a hand held masking machine of the type comprising: a frame having a front edge; a handle attached to said frame and adapted to be grasped by a person using the masking machine; masking material mounting means on said frame, adapted for mounting the roll of masking material for generally coaxial rotation about a masking material axis defined by the mounting means so that masking material from the roll can be conducted past the front edge of the frame; first and second tape roll mounting means on said frame adapted for mounting first and second rolls of pressure sensitive adhesive coated tape having axes and axially spaced opposite edges for coaxial rotation about tape roll axes generally parallel to said masking material axis with each of said rolls of tape adjacent a different lateral edge of the masking material and positioned on the side of said masking material mounting means opposite the front edge of said frame, said tape roll mounting means being adapted to position the rolls of tape along said tape roll axes with a portion of each roll of tape along the adjacent edges of the rolls of tape aligned with portions of the roll of masking material along the adjacent edge of the roll of masking material, and with a portion of each roll of tape projecting past the adjacent edge of the roll of masking material, and so that tapes conducted from the rolls of tape past said front edge will contact and become adhered to masking material being conducted from said roll of masking material with portions of the tapes projecting past the opposite lateral edges of the masking material; and cutting means along the front edge of said frame adapted for cutting the adhered together masking material and tapes, wherein:

said elongate sheet of masking material in said roll is longitudinally folded along a plurality of parallel fold lines, said fold lines including a pair of spaced innermost fold lines each about equally spaced from the adjacent edge of the sheet, the innermost fold lines being spaced from each other a distance about equal to the axial length of the roll to position the innermost pair of spaced fold lines adjacent the end surfaces of the roll with a planar central portion of the sheet extending between said innermost fold lines, and said fold lines also including an odd number of outer fold lines between each edge of the sheet and the adjacent innermost fold line, said outer fold lines forming an even number of portions of the sheet each less than half the width of the central portion of the sheet on the same side of the central portion of the sheet, and positioning each of the edges of the sheet at a different one of the ends of the roll on the side of the folded sheet opposite the central portion of the sheet.

12. A roll of masking material according to claim 11 wherein said odd number of outer fold lines is more than one.

13. A roll of masking material according to claim 11 wherein said odd number of outer fold lines is three.

14. A roll of masking material according to claim 11 wherein said odd number of outer fold lines is nine.

* * * * *

UNITED STATES PATENT AND TRADEMARK OFFICE

CERTIFICATE OF CORRECTION

PATENT NO. : 5,628,866

DATED : May 13, 1997

INVENTOR(S) : POOL, DANIEL L.

It is certified that error appears in the above-indentified patent and that said Letters Patent is hereby corrected as shown below:

Column 10, Line 7, replace "pads" with --parts--.

Signed and Sealed this

Ninth Day of September, 1997

*Attest:*

Bruce Lehman

BRUCE LEHMAN

*Attesting Officer*

*Commissioner of Patents and Trademarks*